United States Patent [19]

Engels

[11] 4,006,887

[45] Feb. 8, 1977

[54] DEVICE FOR CONTINUOUS COATING OF FIBERS

[75] Inventor: Kaspar Engels, Mannheim, Germany

[73] Assignee: Draiswerke GmbH, Mannheim, Germany

[22] Filed: Aug. 11, 1975

[21] Appl. No.: 603,271

[30] Foreign Application Priority Data

Aug. 13, 1974 Germany ..... 2438818
Feb. 18, 1975 Germany ..... 2506784

[52] U.S. Cl. ..... 259/9; 118/303

[51] Int. Cl.[2] ..... B01F 7/02; B01F 15/00; B05B 17/00

[58] Field of Search ..... 259/9–10, 259/25–26, 45–46, 159; 118/19, 24, 303, 418; 222/169

[56] References Cited

UNITED STATES PATENTS

| | | | |
|---|---|---|---|
| 3,163,403 | 12/1964 | Engels | 259/9 |
| 3,595,627 | 7/1971 | Abbott | 259/10 |
| 3,734,471 | 5/1973 | Engels | 259/6 |

*Primary Examiner*—Harvey C. Hornsby
*Assistant Examiner*—Robert Pous
*Attorney, Agent, or Firm*—Browdy and Neimark

[57] ABSTRACT

A device for continuous coating of fibers has a horizontally mounted cylindrical mixing container with an inlet for fibers at one end and an outlet for coated fibers at the other end. The container has a mixing shaft mounted coaxially therewithin, which shaft is driveable at a considerably supercritical speed. The shaft is at least partially hollow and is provided with a glue feed through its interior. In a glue feed zone of the container the shaft is provided with glue agitating elements projecting therefrom and dispensing glue to the ring of fibers formed in the vicinity of the wall of the container. The shaft also has ventilator ridges mounted thereon extending radially outwardly for most of the length of the shaft, which ventilator ridges support mixing tools which extend into the ring of fibers.

18 Claims, 5 Drawing Figures

DEVICE FOR CONTINUOUS COATING OF FIBERS

FIELD OF THE INVENTION

The present invention relates to mixing apparatus for continuously coating fibers and more particularly to such apparatus which achieves homogeneous lump-free coating of the fibers.

BACKGROUND OF THE INVENTION

Devices are known with a horizontally mounted cylindrical container, a hollow shaft with glue feed means therein, and mixing tools and glue stirring elements. Similar devices are known, for example, from U.S. Pat. No. 3,734,471. They have been found to be very valuable in practice for coating wood chips, especially for coating wood chip mixtures consisting of coarse and medium chips and sawdust. The glue is uniformly distributed over the chips in these known devices by a forced mixing effect in a compact, i.e., relatively dense, mix ring which forms on the inside wall of the mixing container. The mix ring is the ring or cylinder of material being mixed which is held against the outside of the drum by centrifugal force. It was clear to experts looking at these mixers that in order to achieve a uniform coating of the individual chips and particularly to avoid considerable differences in residence times of the individual chips in the mixing container, the passage of air through the mixer should be avoided as much as possible.

In an attempt to use these known ring mixers for coating fibers, it was found that the fibers lump together considerably and jam the mixing container. Hence, satisfactory homogeneous coating of the fibers could not be achieved.

The coating of fibers, especially wood fibers, is very important to the manufacture of so-called wood fiber panels. Such fiber panels, in contrast to normal chip board which has only one smooth surface, can be worked on both the surface and side edges and exhibits a good surface quality at those locations as well.

German Auslegeschrift 1,048,013 discloses an impeller or agitator mixer for the coating of wood chips with dusty components, in which the glue is sprayed into the mixing container through nozzles provided in the upper surface of the horizontally mounted cylindrical mixing container. In this device an air stream is blown axially through the mixing container in order to reduce the residence time of the dusty chip particles relative to the residence time of the coarser chips so as to largely reduce the relatively excessive coating of these dusty wood chip particles. The problem of avoiding relatively excessive coating of dusty particles does not occur in the coating of pure fibers, however.

It is know from German Offenlegungsschrift 1,632,450 to coat wood chips agitated in an air stream in a mixing tube in which glue spray nozzles are mounted.

SUMMARY OF THE INVENTION

The goal of the present invention is to design and improve a device of the type described hereinabove such that homogeneous lump-free coating of fibers, especially wood fibers, is possible.

This goal is achieved according to the present invention by providing devices for producing a swirling of the air in the mixing container and by making the glue agitating elements in the form of mixing rods submerged in the mix ring, said rods having at least one groove extending lengthwise along them and communicating with the interior of the mixer shaft. Surprisingly, it has been found that this measure, and the corresponding method of operation, on the one hand completely prevent accumulation and lumping of the fibers and on the other hand ensure a completely homogeneous coating of the individual fibers. The fibers run through the mixing container in the form of a considerably loose ring and leave the latter in a loose and flowable form, and are uniformly coated as well. The air-swirling can be achieved by using an advantageous embodiment of the present invention in which the mixing container with its mix inlet funnel and its mix outlet funnel are connected directly to an air transport pipe for the fibers. Alternatively or cumulatively several ventilator ridges can be mounted on the mixing shaft, distributed along its circumference, projecting radially from it and extending over a large part of said shaft, said ventilator ridges producing radial air vortices which cause a radial vorticization of the individual fibers in the loose, slightly annular fluidized bed, i.e., the individual fibers are constantly moved outward to the inside wall of the mixing container and thence brought inward again by the air vortex produced by the ventilator ridges, thus achieving a particularly homogeneous wetting of the individual fibers with glue. At the same time, this constant radial circulation of the individual fibers in an approximately annular fluidized bed prevents the fibers from agglomerating (forming clumps), which would otherwise occur because of a lack of flowability of the fibers.

In addition, the ventilator ridges confer considerable reinforcement to the mixer shaft, i.e., its critical speed may be sharply increased without exceeding the critical mixer shaft velocity. In this context, the term "critical mixer shaft velocity" is understood to be the vibration-technical critical speed, i.e., the speed at which the mixer shaft is subject to bending vibrations or torsional oscillations with maximum amplitude. A distinction should be made between the critical mixer shaft velocity and the critical speed of the device. The latter ($n_{crit}$), measured in revolution per minute, develops when $(D/2)W^2 = g$, where W is the angular velocity of the mixer, $g$ is the acceleration due to gravity and D is the diameter of the mixer. Thus, $n_{crit} = 42.3/\sqrt{D}$ (D being measured in meters). It has been found that devices constructed according to the present invention operate particularly well when the mixer shaft is driven at a speed which is 50 to 100% higher than is the case for the wood-chip mixers discussed hereinabove. The mixer shaft is advantageously driven at a speed 20–40 times the critical speed, $n_{crit}$.

For cases in which individual fiber lumps occur, it is advantageous if at least the mixing tools located in the aftermixing zone are made in the form of mixing rods which taper toward the ends. These rods separate any fiber accumulations which may develop. It is advantageous to extend the mixing rods to the vicinity of the mixing container wall. It has been found especially advantageous and simple to mount the mixing rods replaceably on the ventilator ridges.

According to an advantageous improvement of the present invention, the supporting devices holding the mixing rods to the ventilator ridges are mounted removably, so that the supporting devices can advantageously be mounted radially displaceably on the ventilator ridges. This makes it possible to achieve optimum fluidized bed formation by setting the distance of all or only a part of the tapered pointed mixing rods from the inside wall of the mixing container. When the supporting devices are mounted laterally on the ventilator ridges, this radial adjustability is achieved in a particularly simple manner by providing at least one spacer in a replaceable manner between a supporting device and a nose projecting laterally from the ventilator ridge surface which is located radially outward. If the supporting devices are mounted so that they are located radially outside the ventilator ridges, it is particularly advantageous if at least one spacer is replaceably mounted between the supporting devices and the ventilator ridges. With this arrangement of the supporting devices, it is practically possible in this manner to change the radial extent of the ventilator ridges as well, because the supporting devices practically act as radial extensions of the ventilator ridges. According to a particularly simple embodiment, in the arrangement of supporting devices described hereinabove, the spacer or spacers are made in the form of double wedges. It has been found to be optimal to have the ventilator ridges extend radially up to about half the radius of the mixing container, i.e., if their sides which are located on the outside, viewed radially, are located at about 0.4–0.6 times the mixing container radius.

According to a further advantageous feature of the present invention, the glue agitating elements in the glue feed zone are mounted on devices which extend over the length of the glue feed zone, wherein either the ventilator ridges serve as such devices or these devices are made in the form of separate devices located between the ventilator ridges. In the latter case, the vorticization effects described above are intensified even further. It has been found very advantageous in this connection to make the glue agitating elements in the form of tapered mixing rods. They may be provided with grooves laterally located as viewed from the rotation direction, the depth of said grooves decreasing outwardly. The glue agitating elements are therefore designed to be completely identical to the mixing rods themselves.

In a particularly advantageous embodiment, the glue agitating elements have a groove which is located at the front as seen from the direction of rotation, the depth of said grooves decreasing outwardly. Surprisingly, it has been found that due to the air vortices in this arrangement of the grooves, the maximum distribution forces attack the glue, said forces being intensified even further by the impact of the fibers. A portion of the glue runs out to the vicinity of the tip, so that the entire glue agitating element is sufficiently cooled. In addition, generally the provision of grooves for the transport of glue radially outward does not pose the danger of plugging or caking.

Further advantages and features of the invention will be seen from the description of an embodiment with reference to the drawings.

DETAILED DESCRIPTION OF PREFERRED EMBODIMENTS

Figure 1:
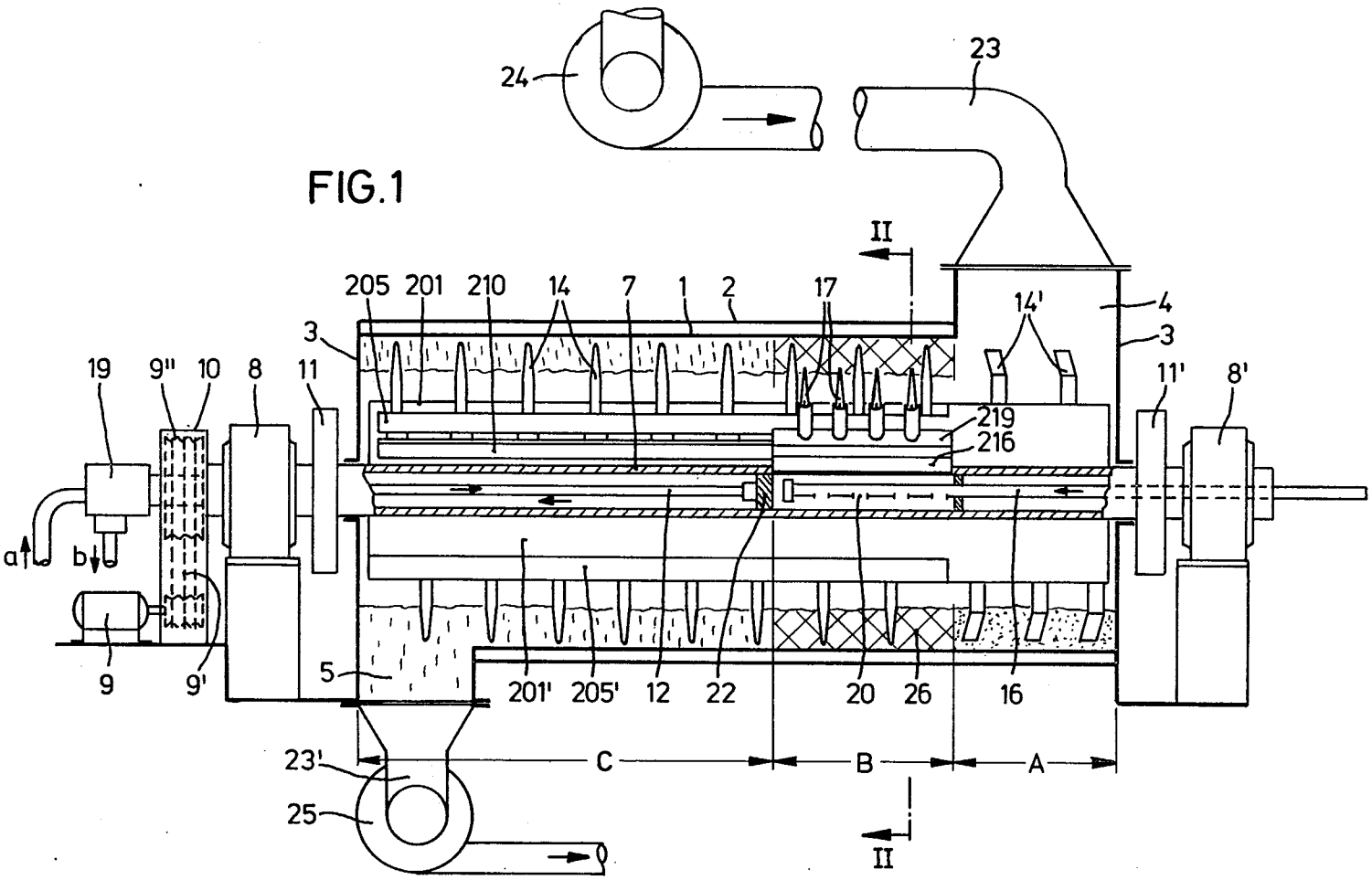
FIG. 1 is a vertical lengthwise section through a device according to the invention, wherein the mixing shaft is shown partially in top view.

The device shown in the drawing is provided with a cylindrical mixing container consisting of an inner trough 1 and a cooling jacket 2, said container being closed at its ends by end walls 3. At one end (the right end in FIG. 1) a mix inlet funnel 4 is provided, emptying into the mixer tangentially from above, and at the other end (the left end in FIG. 1) a mix outlet funnel 5 is provided, also emptying outward tangentially. The mixing container is divided in half, the two halves being held together by toggle joints, not shown. A mixing shaft 7 is mounted coaxially in mixing container 1, 2, said shaft being mounted in bearings 8, 8' and driven by a motor 9 using V-belts 9' using a V-belt pulley 9''. A housing 10 to protect the pulley is mounted around pulley 9''. Mixing shaft 7 is provided with balancing disks 11 and 11'. A cooling water tube 12 is mounted inside mixer shaft 7 and rotates with it. Mixing tools 14, described in further detail below, are mounted on mixer shaft 7. The cooling water enters cooling water tube 12 through a cooling water connection *a* shown at the left in FIG. 1; the water then flows to the end of this tube and through the annular space between the cooling water tube 12 and mixer shaft 7, then returns to cooling water outlet *b*. At the other end of mixer shaft 7, shown at the right in FIG. 1, a glue bath feed tube 16 is mounted, said tube projecting into the hollow mixing shaft but not rotating with it. Glue flows from feed tube 16 through openings 20 into the interior of hollow mixing shaft 7, whence it is agitated by glue agitating element 17, described in more detail below. Hollow mixing shaft 7 is separated by a separating disk 22 into the glue feed and cooling areas. The area of mixing container 1, 2 over which mix inlet funnel 4 extends lengthwise forms fiber feed zone A. The mixing tools 14' mounted in this area are formed similarly to the blades of axial turbines, which impart radial, tangential, and axial impulses to the fibers fed through the mix inlet funnel and thus ensure the formation of an annular fluidized bed. The length of mixing container 1, 2 above which glue agitator pipe 17 is mounted on hollow mixing shaft 7 forms glue feed zone B. The adjacent area in which mixing tools 14 are mounted is after-mixing zone C. Mix inlet funnel 4 has a feed pipe 23 connected to it in an airtight manner, and mix outlet funnel 5 also has a feed pipe 23' connected to it in an airtight manner, i.e., mixing container 1, 2 is a part of feed line 23, 23'. Alternatively, or possibly also cumulatively, a pressure blower 24 can be provided in feed line 23 or a suction blower 25 can be provided in feed line 23', through which the fibers to be coated can be blown in an air stream through pipe 23, mixing container 1, 2 and feed line 23'. The transport of the fibers in the air stream is accomplished in a very loose fashion, i.e., the fibers are carried along individually in the air stream with relatively low density. When the fibers pass through the mix inlet funnel into mixing container 1, 2 they are so markedly accelerated in feed zone A by mixing tools 14' that they move through mixing container 1, 2 in the form of a mix ring 26, said mix ring 26 being very loose owing to the strong air flow and other means to be described in greater detail below, i.e., the fibers are only present at a very low density, so that clumping together or lumping of the fibers is practically eliminated.

Figure 2:
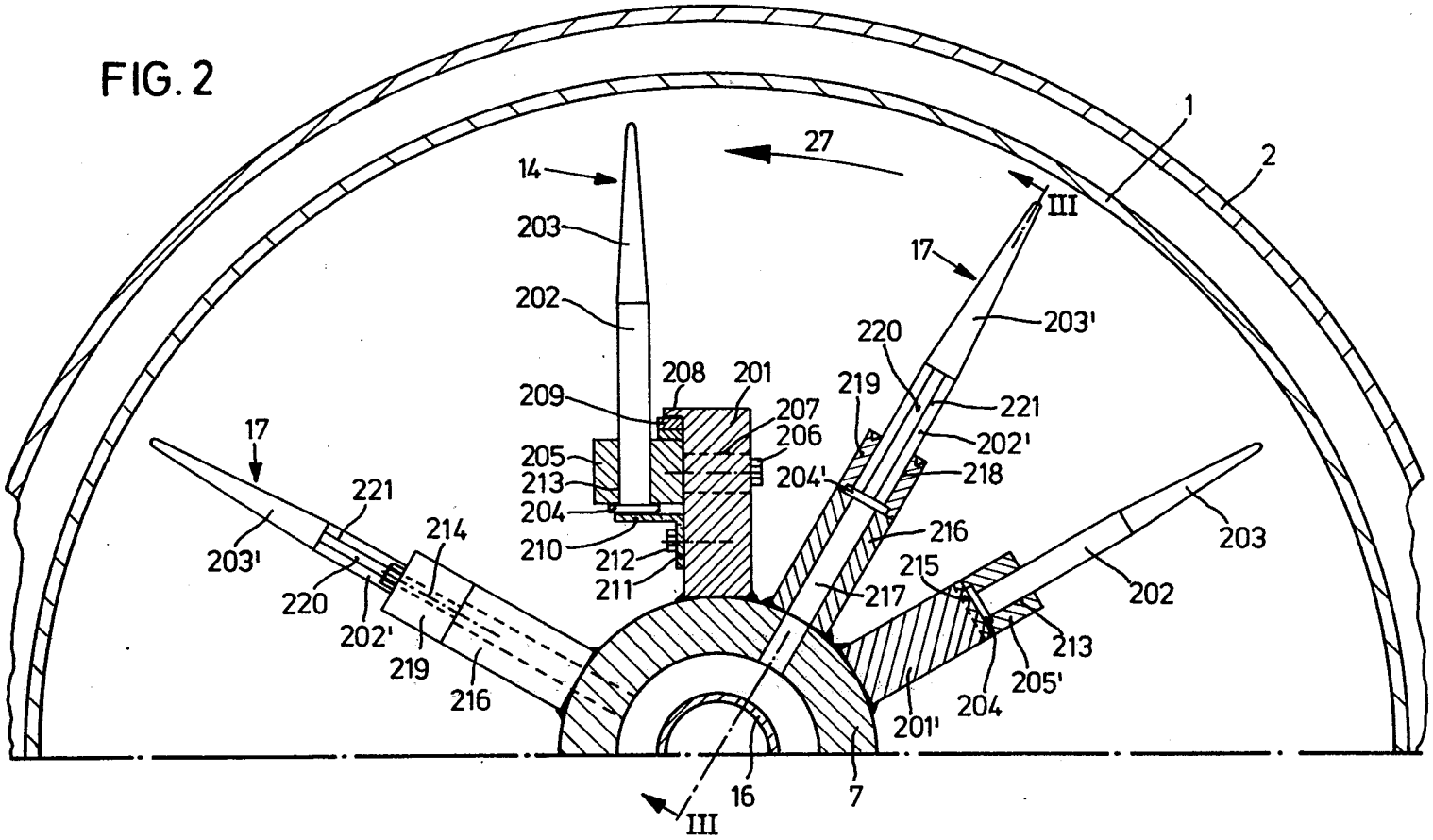
FIG. 2 is a partial cross section through FIG. 1 along line II—II in FIG. 1, shown enlarged.

Supports are welded to mixing shaft 7, extending axially practically for its entire length, being radially extended and serving as ventilator ridges 201 to 201', said supports, as can be seen from FIG. 2, having an approximately rectangular, radially extending cross section. Mixing tools 14' described hereinabove are mounted on ventilator ridges 201 to 201' in feed zone A. In glue feed zone B and aftermixing zone C mixing rods are fastened to ventilator ridges 201 to 201', said rods being approximately radially mounted and serving as mixing tools 14, said mixing rods also having a cylindrical cross section 202 and a conically tapered section 203, said sections 202 and 203 being of approximately equal length. At their inner ends, the mixing rods are provided with a laterally projecting collar 204. Conical section 203 terminates a very short distance from the wall of inside trough 1.

Ventilator ridge 201, which constitutes one embodiment, has a support 205 screwed laterally to it by means of screws 206, said screws also being guided in a radially extending slot 207 in ventilator ridge 201. A nose-shaped projection 208 projects above support 205 from the radially-outside located side of ventilator ridge 201, spacer 209 in the form of a double wedge being provided between projection 208 and the radially-outside-located side of support 205, said spacer being replaceable and serving to determine the outward radial position of support 205.

Below support 205 a corner iron 210 is screwed on by means of screws 212 guided in radially extending slots 211 so that it is radially adjustable on ventilator ridge 201. Radial bores 213 are provided in support 205, the mixing rods being mounted in a practically play-free manner in said bores, wherein the collar 204 rests against the underside of support 205. The free shoulder of corner iron 210 is located beneath cylindrical part 202 of the mixing rod provided with collar 204, so that it cannot fall radially inward when the machine stops. By means of these measures the radial position of the mixing rods and hence their spacing relative to the inside wall of inside trough 1 can be adjusted with considerable precision.

In another embodiment of ventilator ridges 201', supports 205' are fastened to the radially-outside-located side of ventilator ridges 201' by means of screws 214. These supports 205' are also provided with radially extending bores 213, in which the mixing rods are mounted in a practically play-free manner. Collar 204 of each mixing rod rests against the underside of the support 205'. For radial adjustment of the mixing rods, support-shaped spacers 215 can be placed between the radially-outside-located side of ventilator ridge 201' and the facing side of support 205'.

Ventilator ridges 201 and 201' are mounted equal angular distances apart along the circumference of mixer shaft 7, and it has been found advantageous to provide approximately six such ventilator ridges 201.

In glue feed zone B, between ventilator ridges 201 and 201', supports 216, extending over the length of glue feed zone B, are welded to mixer shaft 7, said supports being provided with through bores 217 also extending through mixer shaft 7.

Through these bores 217 the glue is fed to the glue agitating elements 17 from hollow mixer shaft 7, said elements being basically of the same design as the mixing rods, i.e., having a cylindrical cross section 202' and a conically tapering section 203' and a collar 204'. They are mounted in bores 218 of a holder 219, coaxially with respect to bores 217, produced in the same fashion in holder 216 as support 205' on ventilator ridge 201'. Cylindrical section 202' of each glue agitating element 17 is provided with two grooves 220 which decrease in depth outwardly, the depth of said grooves at collar 204' being sufficiently great that the grooves communicate with bores 217 (see FIG. 3). The grooves are located laterally on the glue agitating elements as viewed in the direction of rotation 27. On the basis of the high centrifugal pressure of the glue at the extremely high speed of rotation required, amounting to 20 to 40 times the critical speed of rotation, the glue is forced through bore 217 to grooves 220 and flows out through grooves 220. Since the glue only flows in the form of a film through grooves 220, the adhesion forces are greater than the tangentially acting forces of inertia of the individual drops of glue. Due to the air currents which are present, however, a portion of the glue is pulled off on its way outward over the edges 221 of grooves 220 which are located to the rear with direction of rotation 27, so that a general glue distribution is achieved which corresponds to the local fiber concentration. In other words, this means that in the areas located close to the mixing shaft 7, where relatively few fibers are located, relatively little glue will be distributed, while more glue will be dispensed in those areas that are located further outward toward the mixing container inside wall, where the fiber concentration is greater. This ensures an extraordinarily homogeneous distribution of the glue over the individual fibers.

It should be mentioned in this connection that the cooling of mixer shaft 7 described above is not absolutely necessary, since it has been found that the fibers practically never come in contact with the mixer shaft, so there is no danger of the glue caking on mixer shaft 7.

Figure 3:
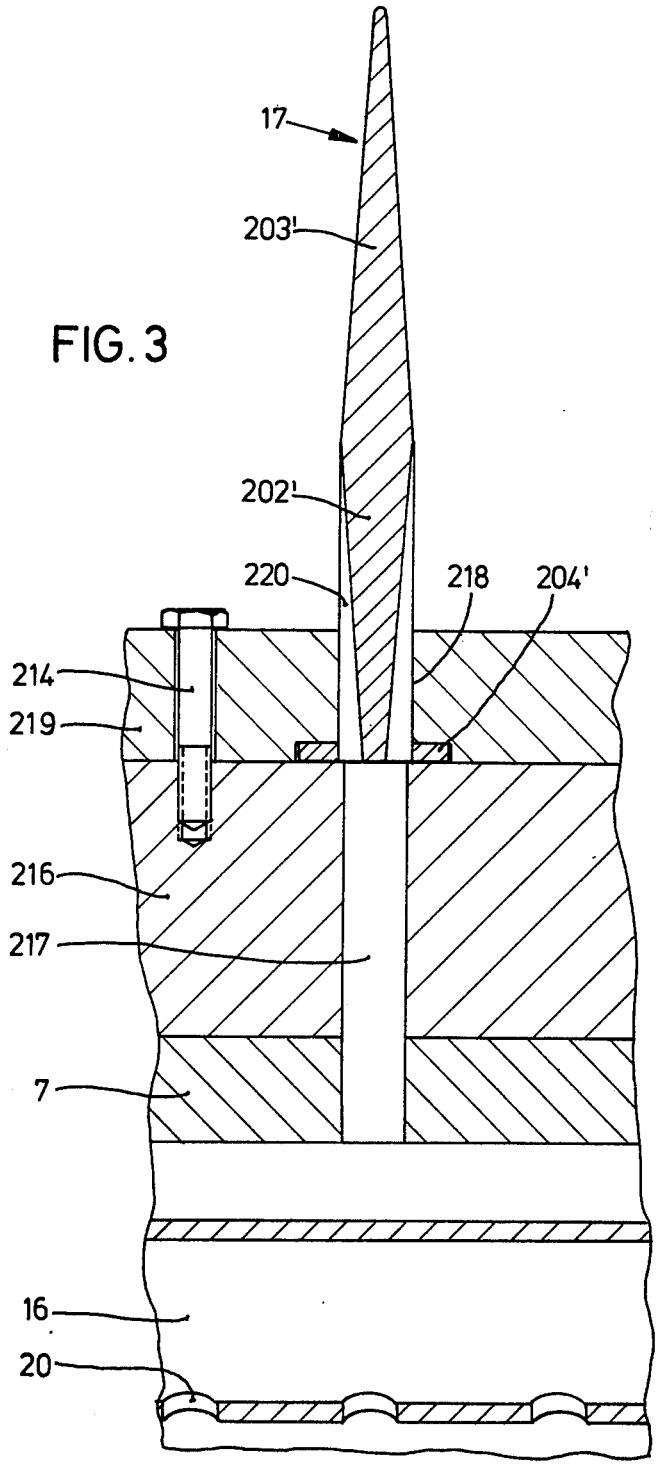
FIG. 3 is a lengthwise section through a glue agitating element along line III—III in FIG. 2.
Figure 4:
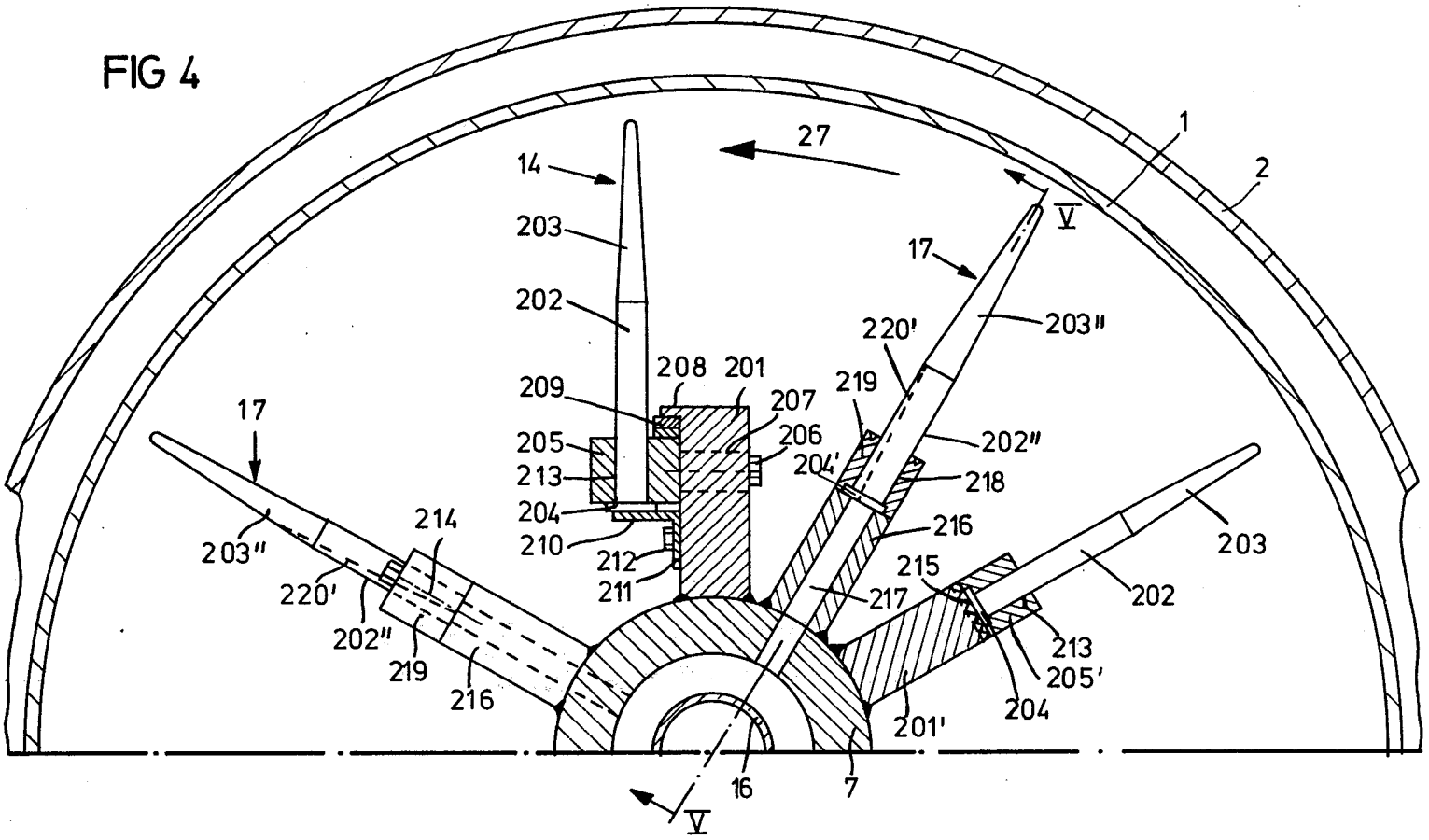
FIG. 4 is a partial cross section according to FIG. 2 with glue agitation elements with only one groove.
Figure 5:
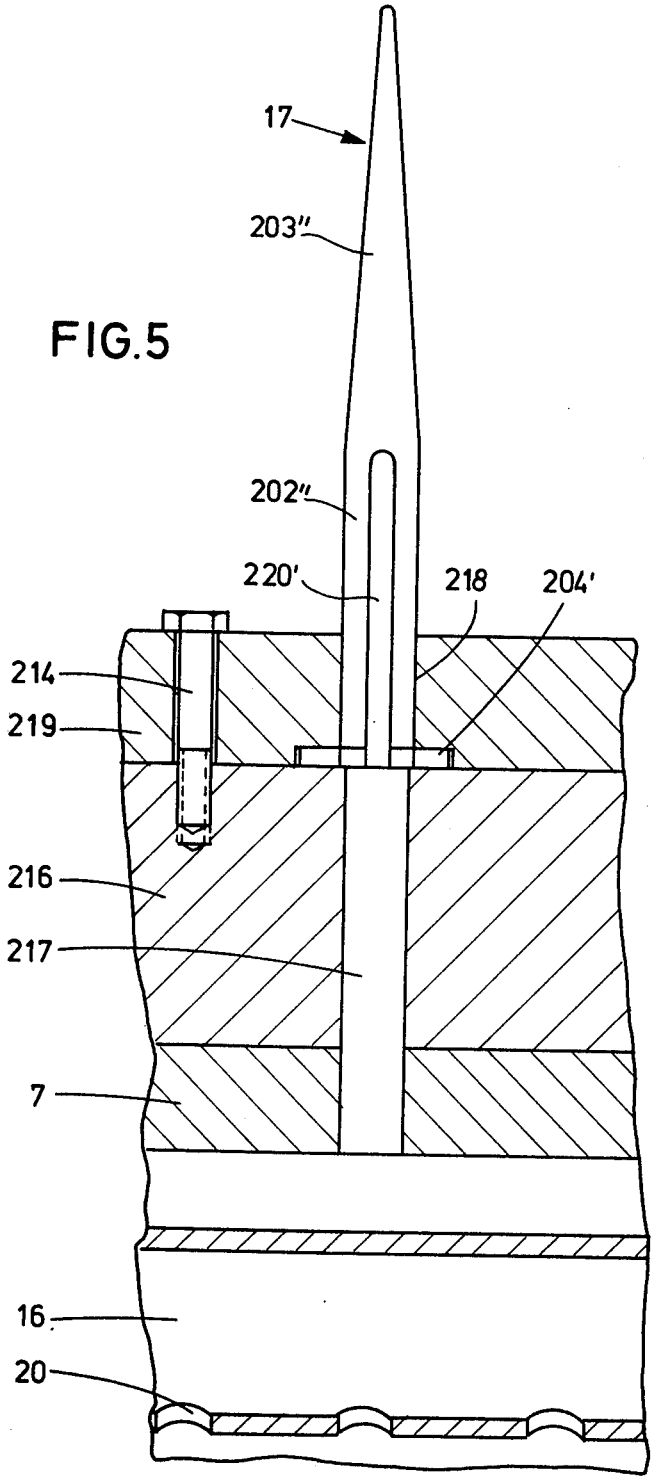
FIG. 5 is a lengthwise section through a glue agitating element along line V—V in FIG. 4.

The embodiment shown in FIGS. 4 and 5 differs from the embodiment in FIGS. 2 and 3 only in that glue agitating elements 17, consisting of cylindrical segment 202'' and conically tapering section 203'', are provided with only one groove 220' located in front as seen from direction of rotation 27. The shape of the groove and its connection with the interior of hollow mixing shaft 7 is the same as in the embodiment shown in FIGS. 2 and 3. In FIG. 4, left glue agitating element 17 is provided with a groove 220' which extends to the lower third of conical taper 203'', while groove 220' extends up to the transition from cylindrical segment 202'' to conical segment 203'' in right glue agitating element 17 shown in FIG. 4.

It will be obvious to those skilled in the art that various changes may be made without departing from the scope of the invention and the invention is not to be considered limited to what is shown in the drawings and described in the specification.

What is claimed is:

1. A device for continuous coating of fibers, comprising:

a horizontally mounted cylindrical mixing container;

an inlet funnel entering into one end of said container;

an outlet funnel connected to the other end of said container;

a mixing shaft mounted coaxially within said container, said shaft being at least partially hollow;

drive means connected to said mixing shaft for driving said shaft at considerably supercritical speeds;

glue feed means for feeding glue into at least a portion of the interior of said shaft;

mixing tools connected to said shaft at least on an axial portion thereof;

glue agitating elements connected to said shaft on an axial portion thereof and extending into the ring of material formed on the inside wall of the cylindrical mixing container when said shaft is operated at a considerably supercritical speed, said elements being in the form of mixing rods extending into the ring of material, each of said rods being provided with at least one groove extending in the lengthwise direction, each of said grooves being open outwardly along its entire length and each of said grooves communicating with the interior of said mixer shaft for allowing dispensing of glue into the ring of material; and means for ensuring air vorticization in said cylinder;

whereby fibers may be substantially homogeneously coated while avoiding substantial jamming and lumping of the fibers in the mixing container.

2. A device in accordance with claim 1 including air transport means operationally connected to said inlet and outlet funnels and said cylinder for causing the fibers to be transported through said inlet funnel, said cylinder, and said outlet funnel and for causing air vorticization in said cylinder.

3. A device in accordance with claim 1 wherein said ventilator means for ensuring air vorticization in said cylinder comprises a plurality of ventilator ridges mounted on said shaft, said ventilator ridges being distributed along the circumference of said shaft, extending radially therefrom and each extending over a large portion of the length thereof.

4. A device in accordance with claim 1 wherein said mixing tools are in the form of outwardly tapering rods.

5. A device in accordance with claim 4 wherein said mixing rods extend to the vicinity of the wall of said container.

6. A device in accordance with claim 3 wherein said mixing tools are in the form of outwardly tapering rods replaceably mounted on said ventilator ridges.

7. A device for continuous coating of fibers, comprising:

a horizontally mounted cylindrical mixing container;

an inlet funnel entering into one end of said container;

an outlet funnel connected to the other end of said container;

a mixing shaft mounted coaxially within said container, said shaft being at least partially hollow;

drive means connected to said mixing shaft for driving said shaft at considerably supercritical speeds;

glue feed means for feeding glue into at least a portion of the interior of said shaft;

mixing tools connected to said shaft at least on an axial portion thereof;

means for ensuring air vorticization in said cylindrical mixing container including a plurality of ventilator ridges mounted on said shaft, said ventilator ridges being distributed along the circumference of said shaft, extending radially therefrom and each extending over a large portion of the length thereof;

glue agitating elements connected to said shaft on an axial portion thereof and extending into the ring of material formed on the inside wall of the cylindrical mixing chamber when said shaft is operated at a considerably supercritical speed, said elements being in the form of outwardly tapering mixing rods extending into the ring of material and being replaceably mounted on said ventilator ridges, said rods being each provided with at least one groove extending in the lengthwise direction and communicating with the interior of said mixer shaft, thereby allowing dispensing of glue into the ring of material; and mixing rod support means for mounting said mixing rods on said ventilator ridges.

8. A device in accordance with claim 7 wherein said mixing rod support means supports said mixing rod in a radially displaceable manner.

9. A device in accordance with claim 8 wherein said mixing rod support means comprises a support mounted laterally on said ventilator ridges, a nose projecting laterally from the radially outward side of the ventilator ridge and a spacer replaceably mounted between said nose and said support.

10. A device in accordance with claim 8 wherein said mixing rod support means comprises a support mounted on the radial end of said ventilator ridges and a spacer replaceably mounted between said support and said ventilator ridge.

11. A device in accordance with claim 9 wherein said spacer is made in the form of a double wedge.

12. A device in accordance with claim 3 wherein said ventilator ridges extend radially to approximately half the mixing container radius.

13. A device in accordance with claim 1 wherein said container has a fiber feed zone in the vicinity of said inlet funnel, a glue feed zone downstream of said fiber feed zone and an aftermixing zone downstream of said glue feed zone for the remainder of the length of said cylinder, wherein said glue agitating elements are mounted on element supports extending over the length of said shaft within the glue feed zone.

14. A device in accordance with claim 13 wherein said means for ensuring air vorticization in said cylinder comprises a plurality of ventilator ridges mounted on said shaft, said ventilator ridges being distributed along the circumference of said shaft, extending radially therefrom and each extending over a large portion of the length thereof, and wherein said element supports are mounted on said shaft between said ventilator ridges.

15. A device in accordance with claim 1 wherein said glue agitating elements are in the form of outwardly tapering rods.

16. A device in accordance with claim 1 wherein said glue agitating elements extend to the vicinity of the wall of said container.

17. A device for continuous coating of fibers, comprising:

a horizontally mounted cylindrical mixing container;

an inlet funnel entering into one end of said container;

an outlet funnel connected to the other end of said container;

a mixing shaft mounted coaxially within said container, said shaft being at least partially hollow;

drive means connected to said mixing shaft for driving said shaft at considerably supercritical speeds;

glue feed means for feeding glue into at least a portion of the interior of said shaft;

mixing tools connected to said shaft at least on an axial portion thereof;

glue agitating elements connected to said shaft on an axial portion thereof and extending into the ring of material formed on the inside wall of the cylindrical mixing container when said shaft is operated at a considerably supercritical speed, said elements being in the form of mixing rods extending into the ring of material, said rods being each provided with laterally located grooves as viewed in the direction of rotation of said shaft, the depths of said grooves decreasing outwardly, the grooves extending in the lengthwise direction and communicating with the interior of said mixer shaft, thereby allowing dispensing of glue into the ring of material; and means for ensuring air vorticization in said cylinder.

18. A device in accordance with claim 1 wherein said glue agitating elements comprise mixing rods each provided with a groove located in front as viewed in the direction of rotation of said shaft, the depth of said groove decreasing outwardly.

* * * * *